US009631801B2

(12) United States Patent
Que

(10) Patent No.: US 9,631,801 B2
(45) Date of Patent: Apr. 25, 2017

(54) FLEXIBLE FLAT CABLE CONNECTOR, DIRECT-TYPE BACKLIGHT MODULE, AND CABLE ARRANGEMENT DEVICE

(71) Applicant: Shenzhen China Star Optoelectronics Technology Co., Ltd., Shenzhen, Guangdong (CN)

(72) Inventor: Chengwen Que, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 146 days.

(21) Appl. No.: 14/442,489

(22) PCT Filed: Mar. 3, 2015

(86) PCT No.: PCT/CN2015/073588
§ 371 (c)(1),
(2) Date: May 13, 2015

(87) PCT Pub. No.: WO2016/131200
PCT Pub. Date: Aug. 25, 2016

(65) Prior Publication Data

US 2016/0363306 A1 Dec. 15, 2016

(30) Foreign Application Priority Data

Feb. 16, 2015 (CN) ..... 2015 1 0084457

(51) Int. Cl.
*H01R 12/24* (2006.01)
*F21V 23/06* (2006.01)
(Continued)

(52) U.S. Cl.
CPC ..... *F21V 23/06* (2013.01); *H01R 12/79* (2013.01); *H01R 13/24* (2013.01); *H01R 13/501* (2013.01);
(Continued)

(58) Field of Classification Search
USPC ..... 439/493, 495, 498, 505
See application file for complete search history.

(56) References Cited

U.S. PATENT DOCUMENTS 7,341,477 B2 * 3/2008 Kato ..... H01R 12/79 439/260
7,740,386 B2 * 6/2010 Tsuji ..... F21V 21/002 362/249.02
(Continued)

FOREIGN PATENT DOCUMENTS

CN 102882069 A 1/2013

*Primary Examiner* — Tho D Ta
(74) *Attorney, Agent, or Firm* — Andrew C. Cheng

(57) ABSTRACT

A flexible flat cable (FFC) connector includes a bottom seat, a top cover rotatably hinged on the bottom seat, at least one elastic part disposed on the bottom seat, wherein, a top portion of the elastic part is protruded out from a top surface of the bottom seat and a bottom portion of the elastic part is extended out from a bottom surface of the elastic part, and a positioning part protruded on the top surface of the bottom seat. A free end of the top cover is provided with a bent extension portion, and the bent extension portion is used for fixing the top cover on the bottom seat. A backlight module and a cable arrangement device are also disclosed. The FFC connector can fix the FFC well. A reliable electric connection can be achieved. The assembly efficiency of the backlight module can also be increased.

17 Claims, 3 Drawing Sheets

(51) Int. Cl.

| | |
|---|---|
| ***H01R 12/79*** | (2011.01) |
| ***H01R 13/24*** | (2006.01) |
| ***H01R 13/50*** | (2006.01) |
| ***H01R 13/639*** | (2006.01) |
| *H01R 12/88* | (2011.01) |
| *H01R 12/61* | (2011.01) |
| *H01R 33/92* | (2006.01) |
| *F21Y 103/10* | (2016.01) |
| *F21Y 115/10* | (2016.01) |

(52) U.S. Cl.
CPC ..... *H01R 13/639* (2013.01); *F21Y 2103/10* (2016.08); *F21Y 2115/10* (2016.08); *H01R 12/61* (2013.01); *H01R 12/88* (2013.01); *H01R 33/92* (2013.01)

(56) References Cited

U.S. PATENT DOCUMENTS 8,579,654 B2 * 11/2013 Chen ..... H01R 12/61 439/267
2008/0045076 A1 * 2/2008 Dittmann ..... H01R 23/661 439/495

* cited by examiner

FLEXIBLE FLAT CABLE CONNECTOR, DIRECT-TYPE BACKLIGHT MODULE, AND CABLE ARRANGEMENT DEVICE

BACKGROUND OF THE INVENTION

1. Field of the Invention

The present invention relates to a display technology field, and more particularly to a flexible flat cable (FFC), a direct-type backlight module and a cable arrangement device.

2. Description of Related Art

Common backlight modules can be divided into a direct-type backlight module and a side-type backlight module. The direct-type backlight module generally does not require a light guide plate so that the direct-type backlight module has an advantage in cost comparing to the side-type backlight module. Besides, the direct-type backlight module also has an advantage in an application of local light control technology.

Generally, the direct-type backlight module comprises multiple light emitting diodes, and the diodes are evenly distributed at a back case. The diodes are divided into multiple blocks through driving circuits so that more connection lines are required to electrically connect the diodes with a power board. Comparing with the side-type backlight module, a connection method to connect the connection lines with the power board is more complex and a connection technology is also more complex such that assembly efficiency becomes low.

SUMMARY OF THE INVENTION

In view of the deficiencies of the conventional art, the present invention provides a flexible flat cable (FFC) connector and a direct-type backlight module, which can effectively reduce the difficulty of the cable arrangement of the connection lines and improve the assembly efficiency of the backlight module.

In order to achieve above purposes, the present invention utilizes the following technology solution: a flexible flat cable connector, comprising: a bottom seat; a top cover rotatably hinged on the bottom seat; and at least one elastic part disposed on the bottom seat, wherein, a top portion of the elastic part is protruded out from a top surface of the bottom seat and a bottom portion of the elastic part is extended out from a bottom surface of the elastic part; wherein, a free end of the top cover is provided with a bent extension portion, and the bent extension portion is used for fixing the top cover on the bottom seat.

Wherein, the at least one elastic part includes multiple elastic parts; the multiple elastic parts are disposed in the bottom seat and are parallel with each other; each extension direction of the elastic parts is parallel with a rotation axis of the top cover.

Wherein, the at least one positioning part is a protrusion column.

Wherein, the flexible flat cable connector further includes at least one positioning part protruded on the top surface of the bottom seat.

Wherein, the least one positioning part includes four positioning parts, and the four positioning parts are respectively disposed at four corners of the bottom seat.

The present invention also provides a direct-type backlight module, comprising: a back case; multiple light strip assemblies disposed in parallel with each other and spaced at intervals; a flexible flat cable; and multiple flexible flat cable connectors, and each of flexible flat cable connectors includes: a bottom seat; a top cover rotatably hinged on the bottom seat; and at least one elastic part disposed on the bottom seat, wherein, a top portion of the elastic part is protruded out from a top surface of the bottom seat and a bottom portion of the elastic part is extended out from a bottom surface of the elastic part; wherein, a free end of the top cover is provided with a bent extension portion, and the bent extension portion is used for fixing the top cover on the bottom seat; the light strip assemblies are fixed inside the back case; each light strip assembly is provided with one flexible flat cable connector; the flexible flat cable is clamped between the bottom seat and the top cover of each flexible flat cable connector; the flexible flat cable is provided with multiple conductive terminals which are electrically connected with the elastic parts; the bottom portions of the elastic parts are electrically connected with the light strip assemblies.

Wherein, along the width direction of the flexible flat cable is provided with at least one notch portion, and at least one positioning part is protruded on the top surface of the bottom seat, and the positioning part is disposed in the notch portion.

Wherein, the flexible flat cable is disposed orthogonally to a length direction of each light strip assembly.

Wherein, the flexible flat cable connectors are respectively disposed at ends of the light strip assemblies, and a rotation axis of the top cover is perpendicular to the length direction of the light strip assembly.

The present invention also provides a cable arrangement device for the direct-type backlight module, comprising: a winding wheel; a roller; an elastic buffering shaft; and a cutting assembly; wherein, the flexible flat cable is wound on the winding wheel; along a connection line direction of the flexible flat cable connectors, the winding wheel sequentially rolls through every flexible flat cable connector; at the same time, under a press of the elastic buffering shaft, the roller rolls continuously along every flexible flat cable connector and the roller also presses the flexible flat cable; the cutting assembly is used for cutting the flexible flat cable.

The present invention provides a flexible flat cable connector for fixing and clamping a flexible flat cable. The connector can fix the flexible flat cable well and achieve a reliable electric connection between the flexible flat cable and light strip assemblies. At the same time, the direct-type backlight module of the present invention has multiple light strip assemblies disposed in parallel with each other and spaced at intervals. Each light strip assembly is provided with one flexible flat cable connector. After insertion terminals of the flexible flat cable are conductive, the flexible flat cable can achieve the electric connection with each light strip assembly through each flexible flat cable connector. The cable arrangement method is simple and reliable such that the cable arrangement difficulty of the flexible flat cable is decreased, and the assembly efficiency of the backlight module is increased.

BRIEF DESCRIPTION OF THE DRAWINGS

In order to more clearly illustrate the technical solution in the present invention or in the prior art, the following will illustrate the figures used for describing the embodiments or the prior art. It is obvious that the following figures are only some embodiments of the present invention. For the skilled persons of ordinary skill in the art without creative effort, it can also obtain other figures according to these figures.

DETAILED DESCRIPTION OF THE PREFERRED EMBODIMENT

The following content combines figures and embodiments for detail description of the present invention.

First Embodiment

Figure 1:
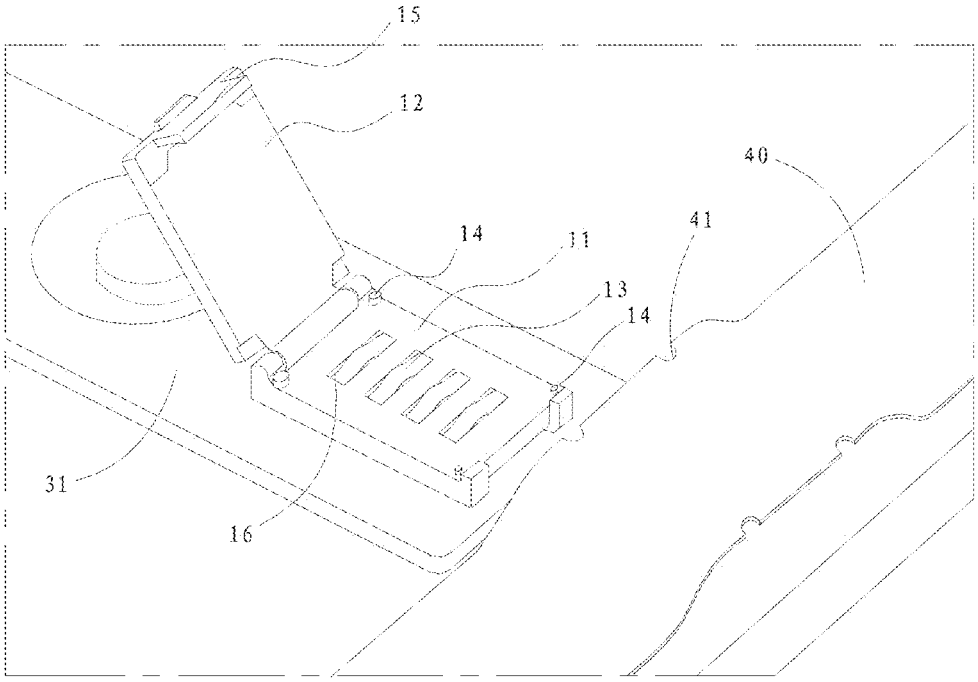
FIG. 1 is a schematic diagram of a FFC connector according to a first embodiment of the present invention.

With reference to FIG. 1, a flexible flat cable (FFC) connector of the present invention includes a bottom seat 11, a top cover 12, an elastic part 13 and a positioning part 14. Wherein, the bottom seat 11 is fixed on a light strip assembly. The top cover 12 is rotatably hinged on the bottom seat 11. The elastic part 13 is disposed on the bottom seat 11. A top portion of the elastic part 13 is protruded out from a top surface of the bottom seat, and a bottom portion of the elastic part 13 is extended out from a bottom surface of the bottom seat 11 so as to be electrically connected with the light strip assembly. The top portion of the elastic part 13 is higher than the top surface of the bottom seat 11. A surface of a flexible flat cable (FFC) 40 which is opposite to the elastic part 13 is provided with a conductive terminal so as to provide an electric conduction function and an elastically abutting function for the flexible flat cable 40 disposed on the bottom seat 11. Accordingly, a reliable electric contact between the flexible flat cable 40 and the elastic part 13 is achieved.

A free end of the top cover 12 is provided with a bent extension part 15. The bent extension part 15 is used for fixing the top cover 12 on the bottom seat 11 in order to clamp the flexible flat cable 40 within the bent extension part 15.

In the present embodiment, multiple elastic parts 13 are disposed in parallel with each other on the bottom seat 11. An extension direction of the elastic parts 13 is parallel with a rotation axis of the top cover 12. In the present embodiment, the bottom seat 11 has multiple parallel receiving slots 16, and the elastic parts 13 are respectively fixed and disposed in the receiving slots 16.

In order to ensure the fixing effect of the flexible flat cable 40 so as to prevent the obliqueness and misalignment of the flexible flat cable 40 and to avoid poor contact of the elastic parts 13, at least one positioning part 14 is disposed on the top surface of the bottom seat 11. Along the width direction of the flexible flat cable 40 is provided with a notch portion 41. The positioning part 14 is disposed in the notch portion 41. In the present embodiment, the number of the positioning parts 14 is four, and are respectively disposed at four corners of the bottom seat 11. In the present embodiment, each of the positioning parts 14 is a protrusion column. In another embodiment, each of the positioning parts 14 can also be a protrusion block.

Second Embodiment

Figure 2:
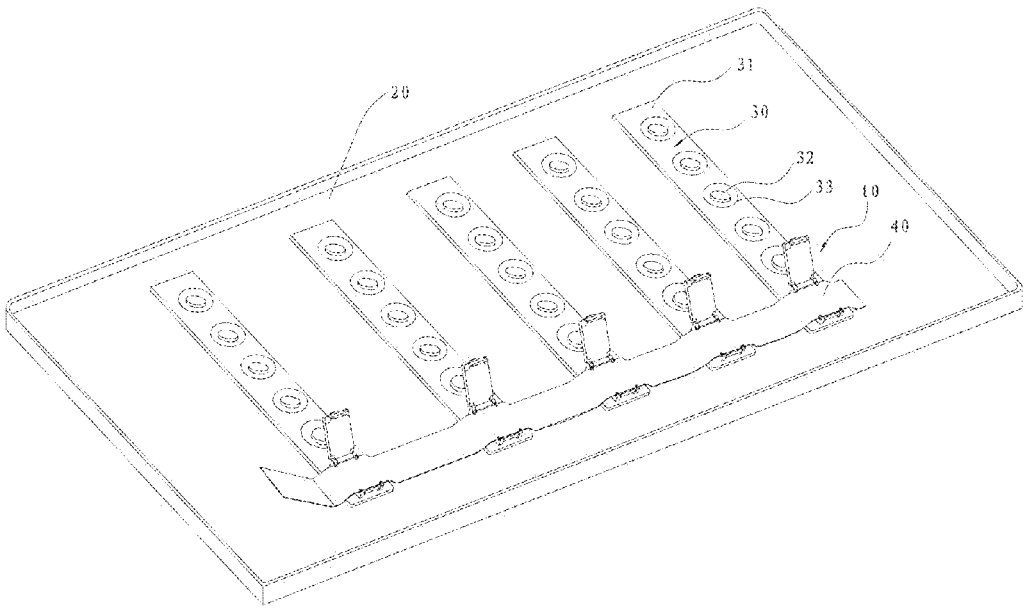
FIG. 2 is a schematic diagram of a backlight module according to a second embodiment of the present invention.
Figure 3:
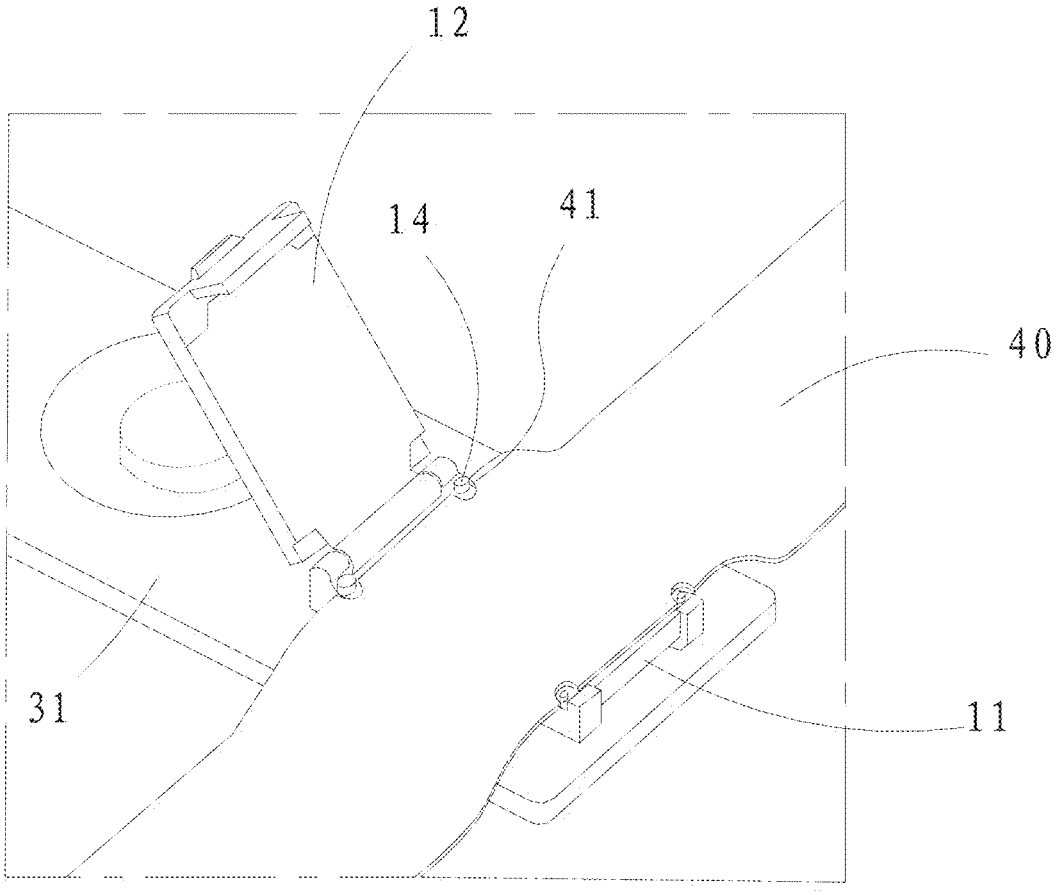
FIG. 3 is a partial enlarged diagram of FIG. 2.

With reference to FIG. 2 and FIG. 3, a direct-type backlight module includes a back case 20, multiple light strip assemblies 30 disposed in parallel with each other and spaced at intervals, a flexible flat cable 40 and a flexible flat cable connector 10. The light strip assemblies 30 are fixed inside the back case 20. Each light strip assembly 30 is correspondingly provided with one flexible flat cable connector 10. The flexible flat cable 40 is clamped between the bottom seat 11 and the top cover 12 of the flexible flat cable connector 10. With combined reference to FIG. 4, the flexible flat cable 40 is provided with multiple conductive terminals 42 which are electrically connected with the elastic parts 13. The bottom portion of the elastic part 13 is electrically connected with the light strip assembly 30.

Each light strip assembly 30 includes a substrate 31, multiple light emitting diode (LED) units 32 and multiple lenses 33. Along the width direction of the flexible flat cable 40 is provided with a notch portion 41. The top surface of the bottom seat 11 has a positioning part 14. The positioning part 14 is disposed in the notch portion 41.

Wherein, the flexible flat cable 40 is disposed orthogonally to a length direction of the light strip assembly 30.

Furthermore, the flexible flat cable connector 10 is disposed at an end of the light strip assembly 30, and a rotation axis of the top cover 12 is perpendicular to the length direction of the light strip assembly 30.

In the present invention, inside the direct-type backlight module, multiple spaced and parallel light strip assemblies are disposed. Each light strip assembly has a flexible flat cable connector. After insertion terminals of the flexible flat cable are conductive, the flexible flat cable can achieve the electric connection with each light strip assembly through each flexible flat cable connector. The cable arrangement method is simple and reliable such that the cable arrangement difficulty of the flexible flat cable is decreased, and the assembly efficiency of the backlight module is increased.

Third Embodiment

Figure 4:
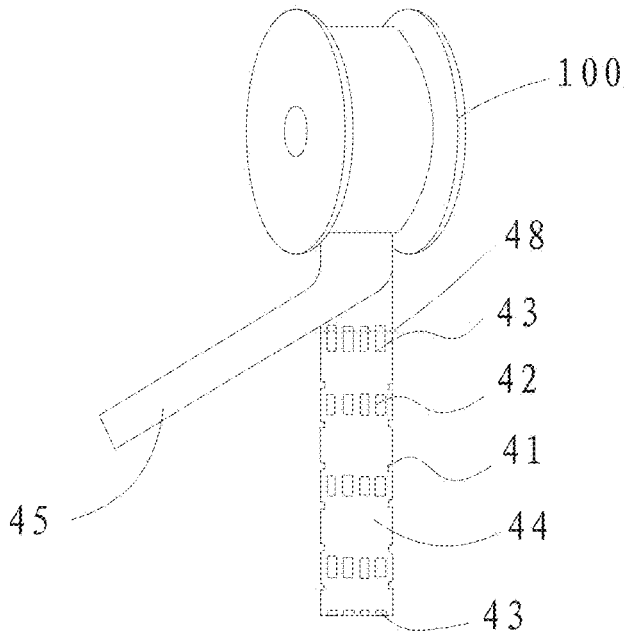
FIG. 4 is a schematic diagram of a flexible flat cable according to a third embodiment of the present invention.
Figure 5:
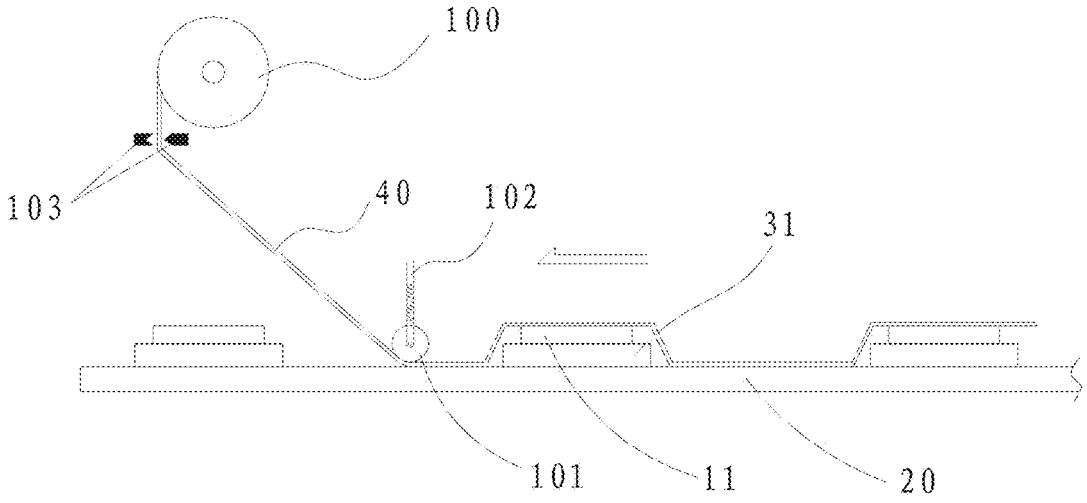
FIG. 5 is a schematic diagram of a cable arrangement device according to the third embodiment of the present invention.

With reference to FIG. 4 and FIG. 5, the flexible flat cable 40 includes a notch portion 41, multiple conductive terminals 42, multiple insertion terminals 43, multiple adhesion portions 44 and a releasing film 45. The insertion terminals 43 are disposed at two ends of the length direction of the flexible flat cable 40. The conductive terminals 42 are located between the multiple insertion terminals 43. Each conductive terminal 42 and each insertion terminal 43 includes multiple contact points in order to ensure the contact reliability with the light strip assemblies 30. After the releasing film 45 is removed, rotating a winding wheel 100. An elastic buffering shaft 102 elastically press a roller 101 under an external force in order to press the flexible flat cable 40. The present invention utilizes the adhesion portions 44 to adhere the flexible flat cable 40 to the back case 20 and corresponding bottom seats 11 of the flexible flat cable connectors 10.

The cable arrangement device of the embodiment of the present invention can be applied to the direct-type backlight module in the second embodiment of the present invention. The cable arrangement device includes a winding wheel 100, a roller 101, an elastic buffering shaft 102 and a cutting assembly 103. The flexible flat cable 40 is wound on the winding wheel 100. Along a connection line direction of the flexible flat cable connectors 10, the winding wheel 100 sequentially rolls through every flexible flat cable connector 10. At the same time, under the press of the elastic buffering shaft 102, the roller 101 rolls continuously along every flexible flat cable connector 10 and the roller 101 also presses the flexible flat cable 40. The cutting assembly 103 is used for cutting the flexible flat cable 40. Along a cutting line 48, a section of the insertion terminals 43 on the winding wheel 100 is cut into two segments.

The cable arrangement device can make the cable arrangement method to be higher in automation. The cable arrangement art can be simplified in order to increase the assembly and cable arrangement efficiency.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A flexible flat cable connector, comprising:

a bottom seat;

a top cover rotatably hinged on the bottom seat; and at least one elastic part disposed on the bottom seat, wherein, a top portion of the elastic part is protruded out from a top surface of the bottom seat and a bottom portion of the elastic part is extended out from a bottom surface of the bottom seat;

wherein, a free end of the top cover is provided with a bent extension portion, and the bent extension portion is used for fixing the top cover on the bottom seat;

wherein, the at least one elastic part includes multiple elastic parts; the multiple elastic parts are disposed in the bottom seat and are parallel with each other; each extension direction of the elastic parts is parallel with a rotation axis of the top cover; and wherein, the flexible flat cable connector includes at least one positioning part protruded on the top surface of the bottom seat.

2. The flexible flat cable connector according to claim 1, wherein, the least one positioning part includes four positioning parts, and the four positioning parts are respectively disposed at four corners of the bottom seat.

3. The flexible flat cable connector according to claim 1, wherein, the at least one positioning part is a protrusion column.

4. The flexible flat cable connector according to claim 3, wherein, the least one positioning part includes four positioning parts, and the four positioning parts are respectively disposed at four corners of the bottom seat.

5. A direct-type backlight module, comprising:

a back case;

multiple light strip assemblies disposed in parallel with each other and spaced at intervals;

a flexible flat cable; and multiple flexible flat cable connectors, and each flexible flat cable connector includes:

a bottom seat;

a top cover rotatably hinged on the bottom seat; and at least one elastic part disposed on the bottom seat, wherein, a top portion of the elastic part is protruded out from a top surface of the bottom seat and a bottom portion of the elastic part is extended out from a bottom surface of the bottom seat;

wherein, a free end of the top cover is provided with a bent extension portion, and the bent extension portion is used for fixing the top cover on the bottom seat; the light strip assemblies are fixed inside the back case; each light strip assembly is provided with one flexible flat cable connector; the flexible flat cable is clamped between the bottom seat and the top cover of each flexible flat cable connector; the flexible flat cable is provided with multiple conductive terminals which are electrically connected with the elastic parts; the bottom portions of the elastic parts are electrically connected with the light strip assemblies.

6. The direct-type backlight module according to claim 5, wherein, the flexible flat cable connector further includes at least one positioning part protruded on the top surface of the bottom seat.

7. The direct-type backlight module according to claim 5, wherein, the flexible flat cable is disposed orthogonally to a length direction of each light strip assembly.

8. The direct-type backlight module according to claim 7, wherein, the flexible flat cable connectors are respectively disposed at ends of the light strip assemblies, and the rotation axis of the top cover is perpendicular to the length direction of the light strip assembly.

9. The direct-type backlight module according to claim 5, wherein, the at least one elastic part include multiple elastic parts; the multiple elastic parts are disposed in the bottom seat and are parallel with each other; each extension direction of the elastic parts is parallel with a rotation axis of the top cover.

10. The direct-type backlight module according to claim 9, wherein, the flexible flat cable is disposed orthogonally to a length direction of each light strip assembly.

11. The direct-type backlight module according to claim 10, wherein, the flexible flat cable connectors are respectively disposed at ends of the light strip assemblies, and a rotation axis of the top cover is perpendicular to the length direction of the light strip assembly.

12. The direct-type backlight module according to claim 5, wherein, along the width direction of the flexible flat cable is provided with at least one notch portion, and at least one positioning part is protruded on the top surface of the bottom seat, and the positioning part is disposed in the notch portion.

13. The direct-type backlight module according to claim 12, wherein, the flexible flat cable is disposed orthogonally to a length direction of each light strip assembly.

14. The direct-type backlight module according to claim 13, wherein, the flexible flat cable connectors are respectively disposed at ends of the light strip assemblies, and a rotation axis of the top cover is perpendicular to the length direction of the light strip assembly.

15. A cable arrangement device used for the direct-type backlight module as claimed in claim 5, comprising:

a winding wheel;

a roller;

an elastic buffering shaft; and a cutting assembly;

wherein, the flexible flat cable is wound on the winding wheel; along a connection line direction of the flexible flat cable connectors, the winding wheel sequentially rolls through every flexible flat cable connector; at the same time, under a press of the elastic buffering shaft, the roller rolls continuously along every flexible flat cable connector and the roller also presses the flexible flat cable; the cutting assembly is used for cutting the flexible flat cable.

16. The cable arrangement device according to claim 15, wherein, along the width direction of the flexible flat cable is provided with at least one notch portion, and at least one positioning part is protruded on the top surface of the bottom seat, and the positioning part is disposed in the notch portion.

17. The cable arrangement device according to claim 16, wherein, the flexible flat cable is disposed orthogonally to a length direction of each light strip assembly.

* * * * *